United States Patent [19]

Hoover

[11] Patent Number: 4,964,787

[45] Date of Patent: Oct. 23, 1990

[54] ELECTRIC VEHICLE PUMP ISOLATION MOUNT

[75] Inventor: Thomas M. Hoover, Reese, Mich.

[73] Assignee: Walbro Corporation, Cass City, Mich.

[21] Appl. No.: 333,906

[22] Filed: Apr. 6, 1989

[51] Int. Cl.[5] ..... F04B 35/04

[52] U.S. Cl. ..... 417/363; 417/423.15

[58] Field of Search ..... 417/360, 363, 371, 410, 417/423.3, 423.14, 423.15, 424.1; 222/385; 248/611, 613, 618, 218.4

[56] References Cited

U.S. PATENT DOCUMENTS 4,569,637 2/1986 Tuckey ..... 417/360

4,768,925 10/1988 Geupel ..... 415/219 R

*Primary Examiner*—Leonard E. Smith

*Assistant Examiner*—Robert N. Blackmon

*Attorney, Agent, or Firm*—Barnes, Kisselle, Raisch, Choate, Whittemore & Hulbert

[57] ABSTRACT

A mounting system for electric pumps used in automotive vehicles, especially those in which the pump is installed in the fuel tank. To reduce pump and pump motor vibrations and noise, which may be objectionable to passengers, the pump is mounted within a cage enclosure carried in the vehicle fuel tank. A suspension for the pump within the cage consists of leaf spring strike-outs in the walls of the cage unit which contact the outer walls and ends of the pump housing to provide a resilient suspension radially and axially.

2 Claims, 3 Drawing Sheets

ELECTRIC VEHICLE PUMP ISOLATION MOUNT

Reference to Related Applications

Reference is made to copending applications Ser. No. 284,996 filed Dec. 16, 1988 and Ser. No. 312,259 filed Feb. 17, 1989, each assigned to a common assignee of this application.

Field of Invention

The mounting of electric vehicle pumps in vehicle fuel tanks to reduce noise and vibration reaching passenger compartments.

Background and Features of the Invention

Since the advent of fuel injection systems, it has become almost universal to utilize electric fuel pumps to furnish fuel to internal combustion engines of automotive vehicles. This system has supplanted the old system of drawing fuel from a tank with a vacuum system or a fuel pump driven in the engine compartment. However, since the fuel tank is usually mounted at the rear of a vehicle below the rear passenger compartment it has become an objective to minimize, as much as possible, the noise and vibration resulting from the rotating, positive-displacement pumps often used for this purpose. This effort has resulted in pump design to reduce flash-back noise. It has also resulted in efforts to mount the pump in such a way as to isolate noise and vibration.

In some instances a canister, that is, a small container is mounted in a fuel tank to receive fuel return from a pressure regulator in the pumping circuit or from an aspirator system. In this arrangement the pump is mounted in the canister, usually parallel to the axis of the canister, and draws fuel from the bottom of the canister to deliver to an outlet conduit leading to the engine fuel supply. One example of a noise reduction structure is found in a patent to Tuckey, U.S. Pat. No. 4,780,063 (1988) where a ribbed pliable jacket is used to surround and mount the pump. Another example is illustrated in the above-referenced copending application of Hoover and Talaski, Ser. No. 284,996, filed Dec. 16, 1988, where metal coil springs mount a pump housing within a jacket which is supported on a fuel return pipe projection within a fuel tank. This return pipe can be in a fuel tank canister or the pump may be mounted in a baffle system in the tank, or in the tank itself.

The present invention approaches the isolation problem in terms of a cage unit which surrounds a pump housing, the cage unit having a mounting means to receive support within a fuel tank on a fuel return pipe, or baffle, or tank flange. The walls of the generally cylindrical unit are provided with leaf spring elements to bear against the side and end walls of the pump body to suspend it resiliently, axially and radially, in the cage unit. While it is not essential to the principles of operations, the forming of the spring elements as strike-outs from the side and end walls of the cylindrical unit reduces the cost of the unit and provides a good life span as well as permitting ready removal of the pump for repair or replacement.

Objects and features of the invention will be apparent in the following specification and claims in which the principles of the invention are set forth together with details to enable persons skilled in the art to practice the invention, all in connection with the best mode presently contemplated for the invention.

Brief Description of the Drawings

DRAWINGS accompany the disclosure and the various views thereof may be briefly described as.

Detailed Description of the Invention and the Manner and Process of Using It

Figure 2:
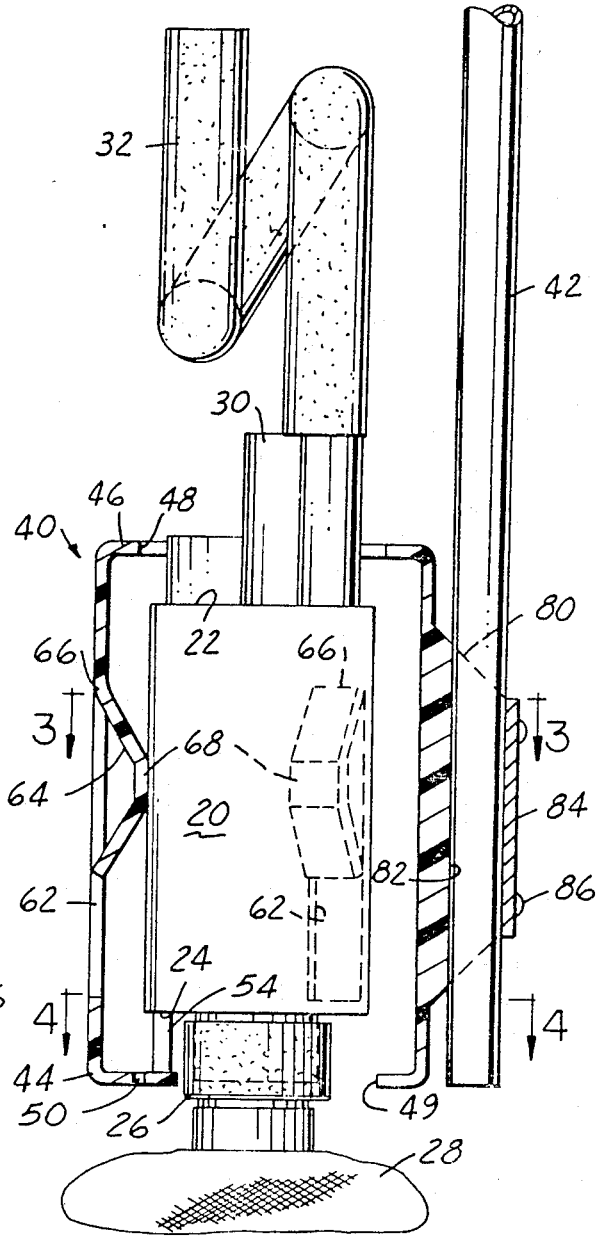
FIG. 2, a sectional view of the cage unit enclosing a pump unit.
Figure 4:
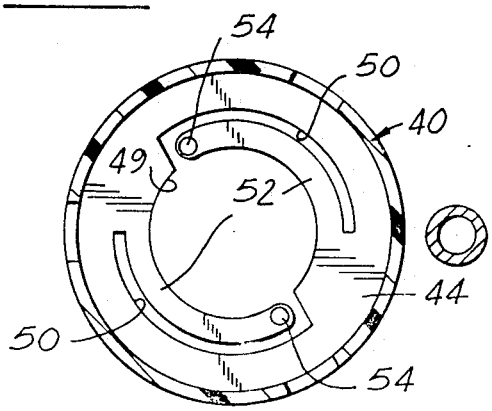
FIG. 4, a sectional view on line 4—4 of FIG. 2
Figure 5:
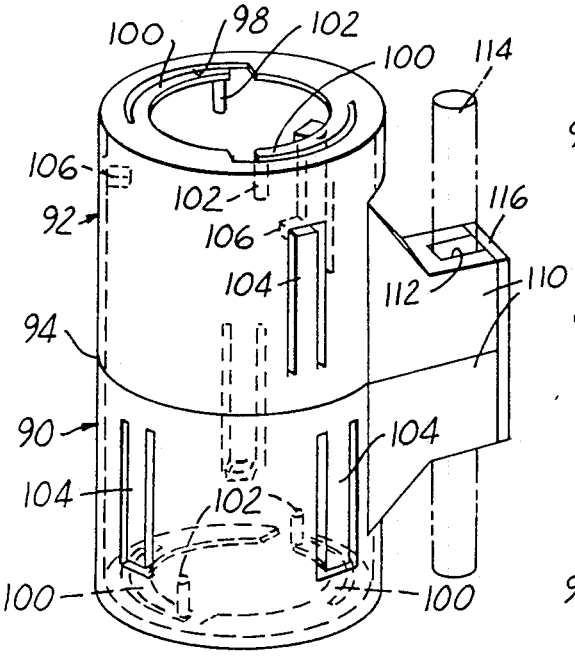
FIG. 5, a perspective view of a modified suspension cage unit.
Figure 6:
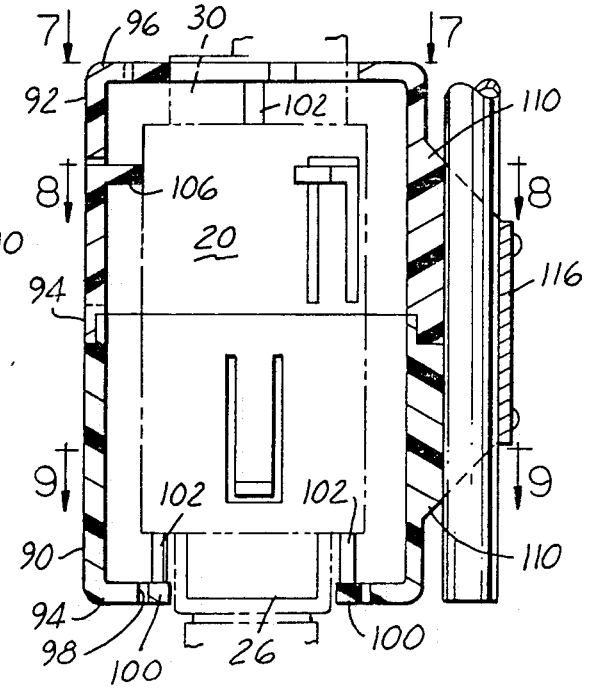
FIG. 6, a sectional view of the unit illustrated in FIG. 5.
Figure 8:
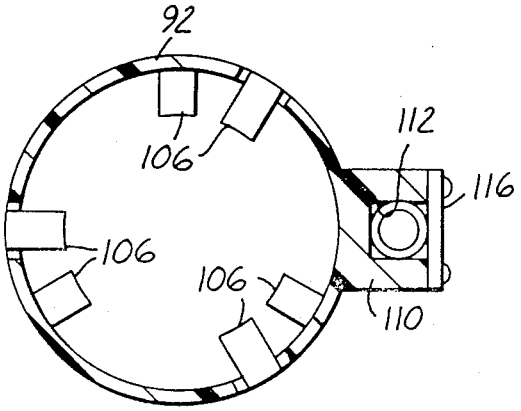
FIGS. 7, 8 and 9, sectional views of FIG. 6 respectively on lines 7—7, 8—8 and 9—9 of FIG. 6.
Figure 7:
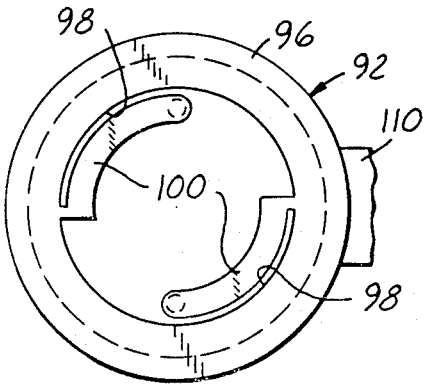
Figure 9:
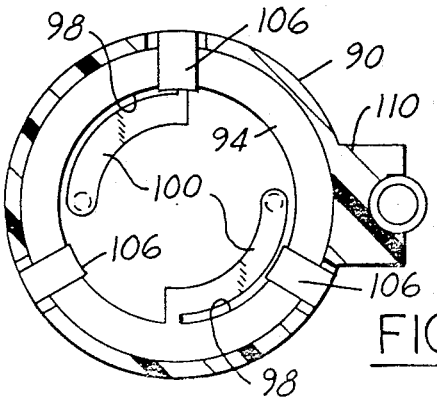

With reference to FIG. 2 of the drawings, an electric fuel pump of relatively standard construction has a cylindrical housing 20 with end walls 22 and 24 and a bottom inlet 26 connected to a filter sack 28 which rests on the bottom of a fuel tank. A pump outlet 30 leads to a fuel conduit 32 connected to a carburetor or a fuel injection manifold.

Figure 1:
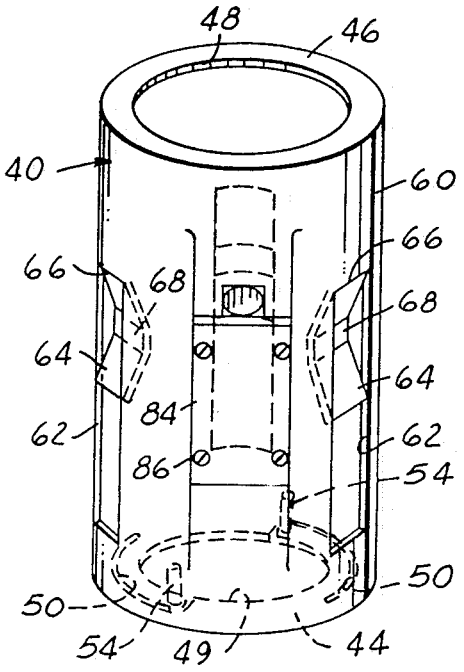
FIG. 1, a perspective view of one embodiment of the cage unit.
Figure 3:
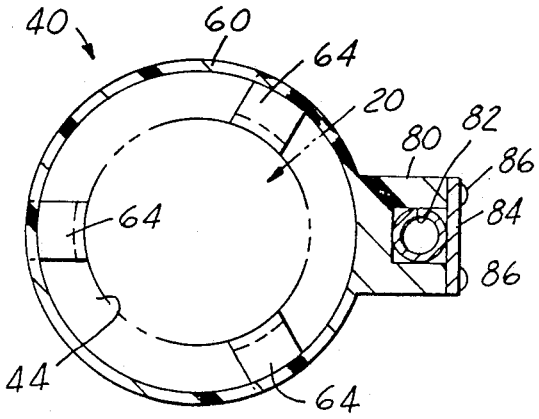
FIG. 3, a sectional view on line 3—3 of FIG. 2.

A support cage unit or open jacket or pod 40 illustrated in FIGS. 1 and 2 comprises a cylindrical enclosure open at each end and supported on a pipe 42 depending into the fuel tank which is not shown. The pipe 42 can be a fuel return pipe mounted in the top of the fuel tank, or the mount may be on a flange, or baffle in the tank.

The jacket 40 is preferably a molded plastic container having a bottom inturned flange 44 and top inturned flange 46. The opening 48 at the top is large enough to receive a pump 20 for insertion and positioning. The bottom flange 44 has a greater radial dimension with an opening 49 and is formed with arcuate slots 50 which extend around the flange about 120° to provide resilient leaf springs 52 with root ends integral with the jacket and on the ends of which are upright pins 54 which will contact the bottom end wall 24 of the pump housing to provide a resilient axial support for the pump.

The cylindrical side wall 60 of the jacket 40 is apertured axially at longitudinal openings 62 and strike-out tabs 64 are integral at root and top ends 66 and shaped inwardly and outwardly to provide contact surfaces 68 which will press resiliently against the outer walls of a pump housing to locate it centrally within the jacket 40. Examples of a suitable material from which to form the cage units are an Acetal plastic, stainless steel, or a steel material with a coating to resist deterioration from contact with hydrocarbons.

The housing 40 has formed integrally therewith a side projection 80 with a slot 82 to receive a support pipe 42 clamped in place by a plate 84 and screws 86. Other clamping configurations can be used for baffles or tank flanges.

Thus, the pump housing 20 can be lowered into the cage 40 against the resilience of the tabs or leaf springs 64 and will be resiliently suspended axially in the cage on supports 52,54.

In FIGS. 5 to 9, a modified cage unit is illustrated composed of bottom and top housings 90 and 92 telescoped together at a central joint 91. Bottom and top flanges 94,96 are each provided with arcuate openings 98 which form resilient leaf tabs 100 with axially extending pins 102.

Each section of the housing is provided strike-out leaf springs 104 without proximal ends integral with the housing wall and each digital end with an inturned tab 106. The leaf springs 104 are circumferentially staggered (FIG. 8) in the top and bottom units. Each section has an outward extension 110 with a recess 112 to receive a support pipe 114 held in place by a clamp plate 116. In this embodiment the leaf springs 100 and 104 are resilient due to the inherent nature of the material from which the housings are formed. While plastic is a preferable material, other materials such as metal could be used. Plastic will have a better sound absorption characteristic and provide a resilient suspension for the pump housing 20.

Figure 10:
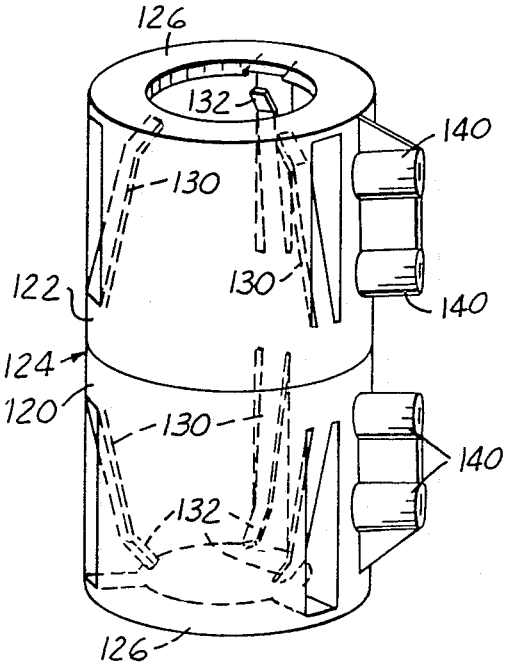
FIG. 10, a perspective view of a second modification.
Figure 11:
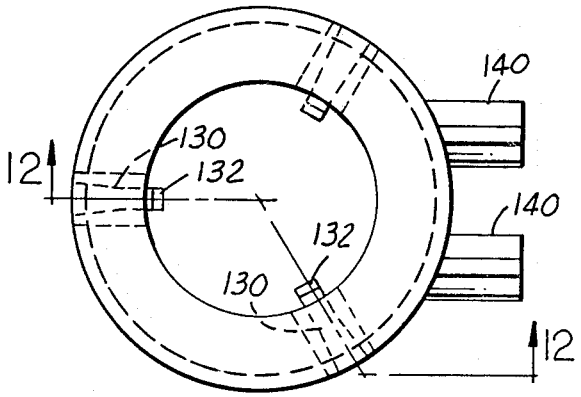
FIG. 11, an end view of the unit illustrated in FIG. 10.
Figure 13:
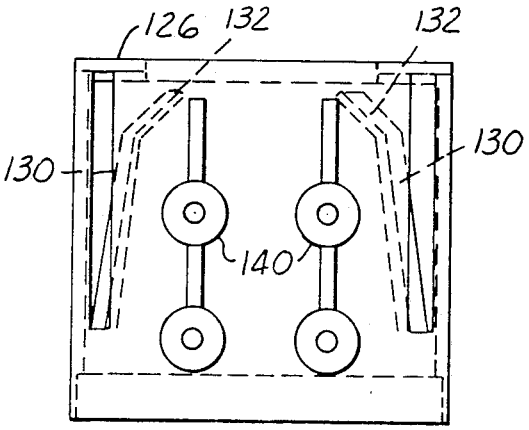
FIG. 13, a side view of one part of the unit illustrated in FIG. 10.
Figure 12:
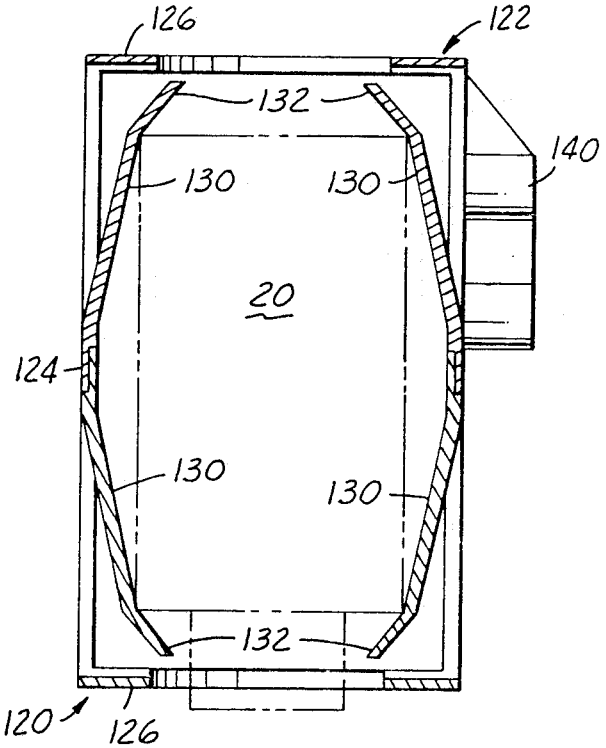
FIG. 12, a sectional view on line 12—12 of FIG. 11.
Figure 5:
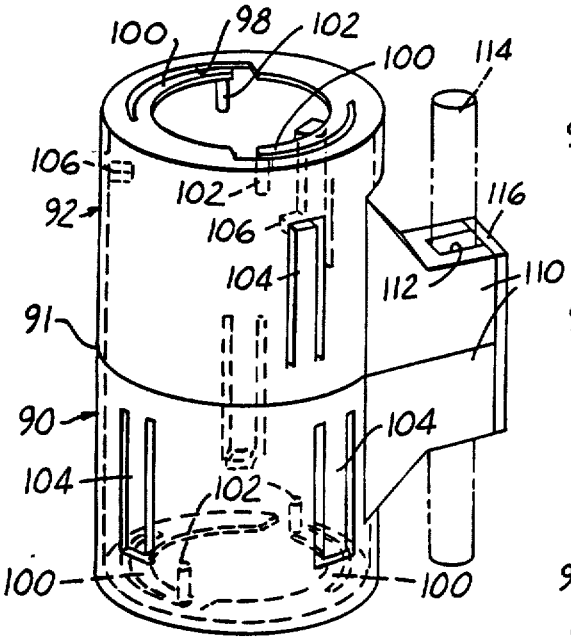
Figure 6:
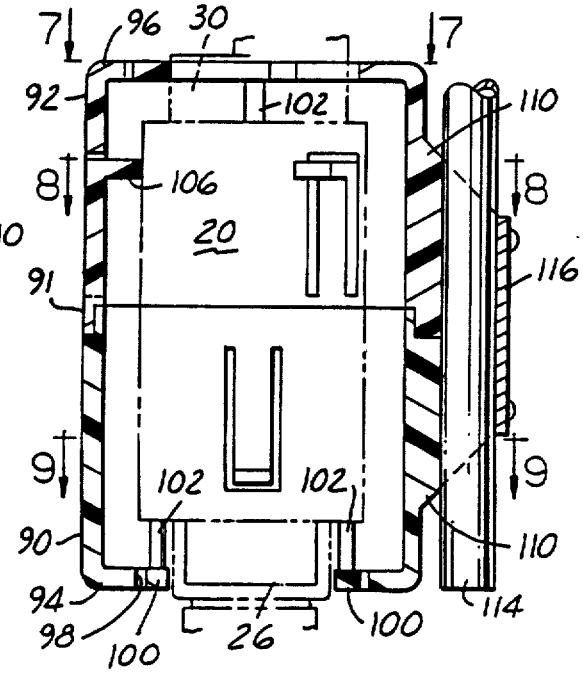
Figure 3:
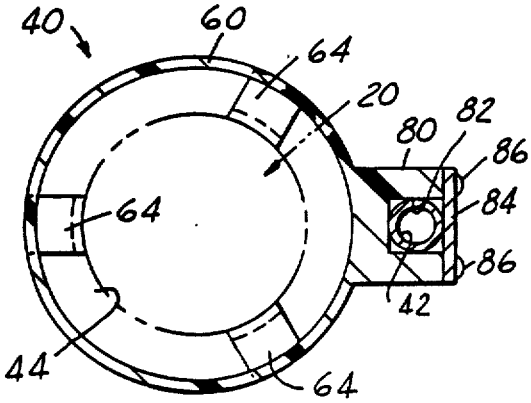
Figure 8:
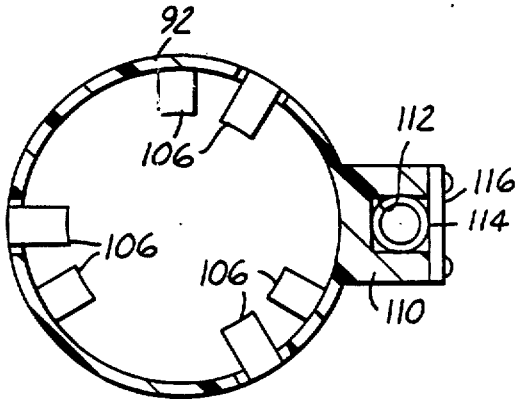
Figure 1:
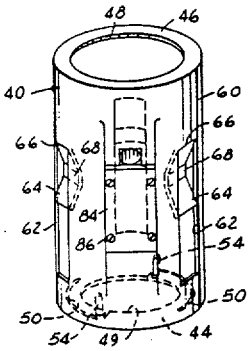
Figure 2:
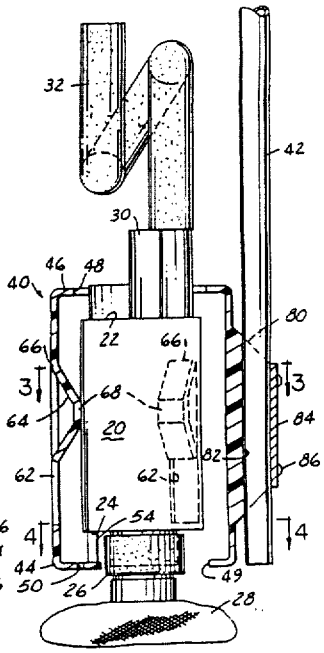
Figure 3:
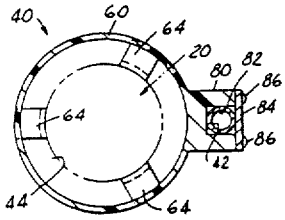
Figure 4:
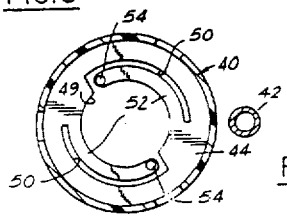
Figure 5:
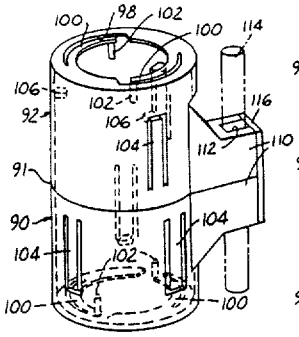
Figure 6:
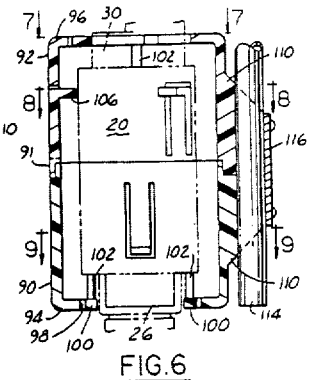
Figure 8:
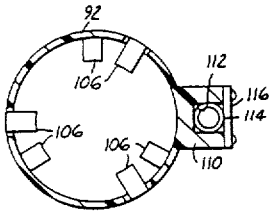
Figure 7:
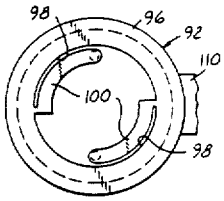
Figure 9:
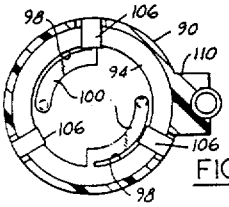
Figure 1:
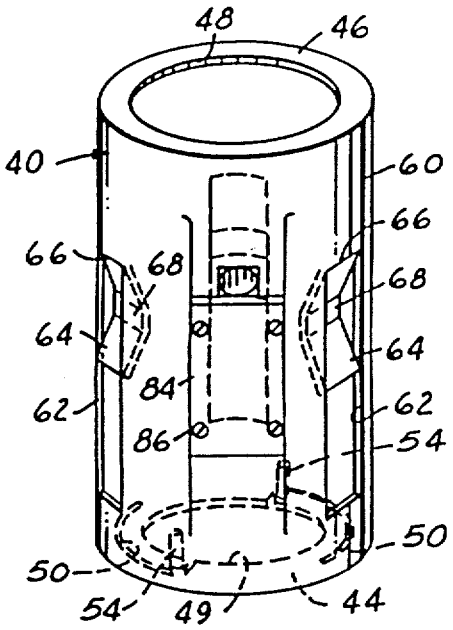
Figure 2:
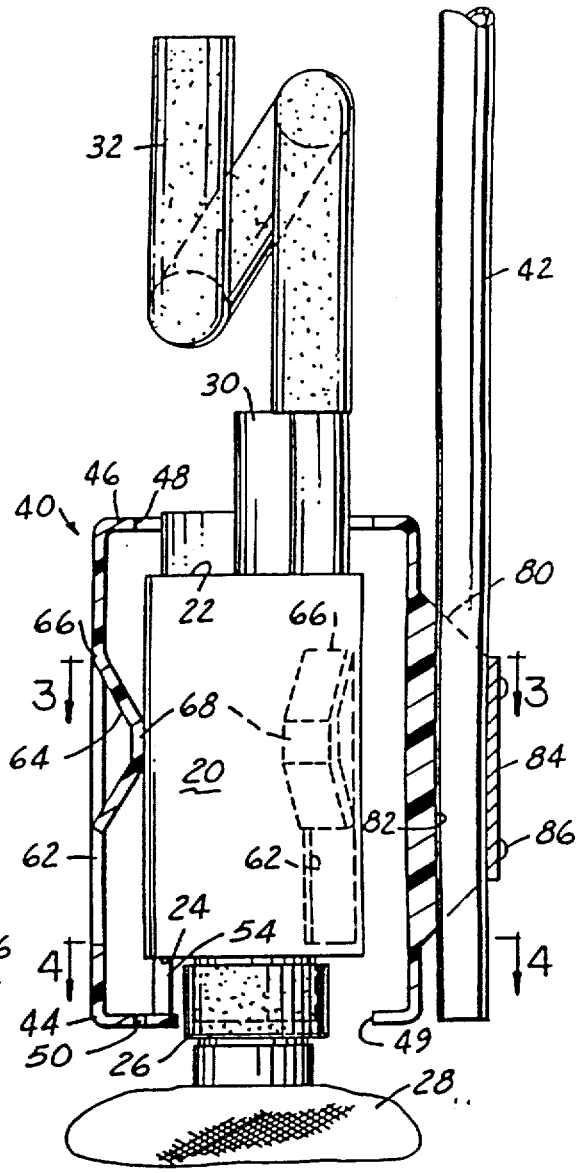
Figure 3:
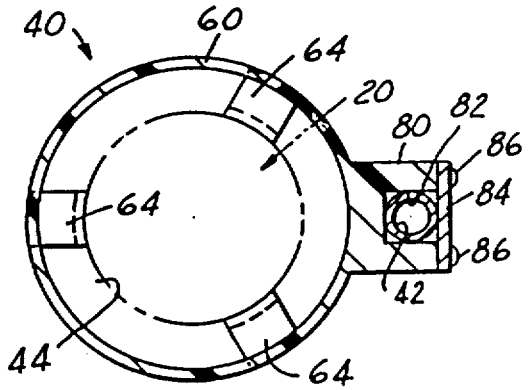
Figure 4:
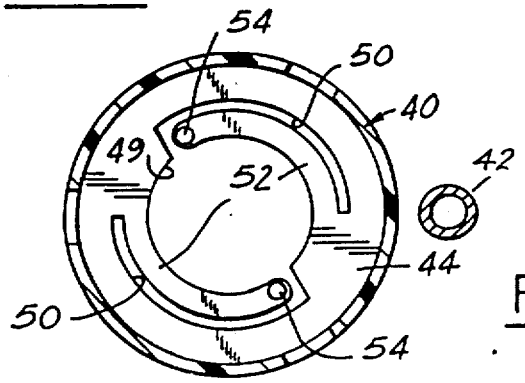
Figure 5:
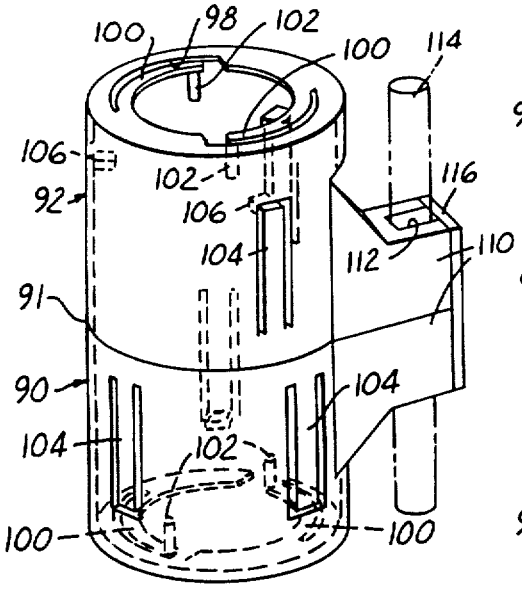
Figure 6:
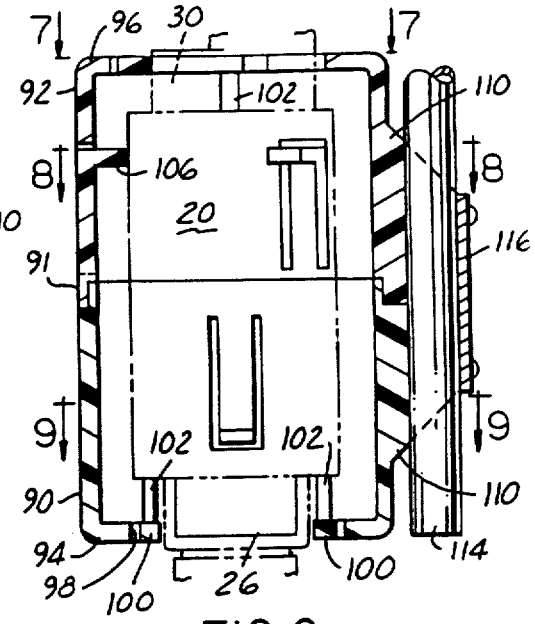
Figure 8:
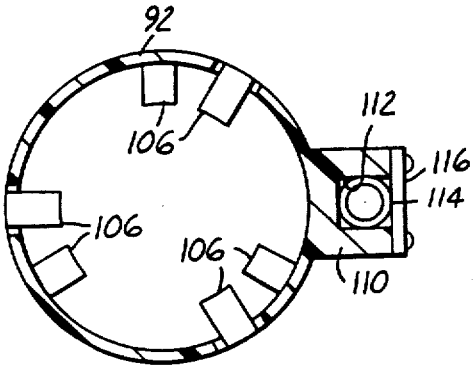
Figure 7:
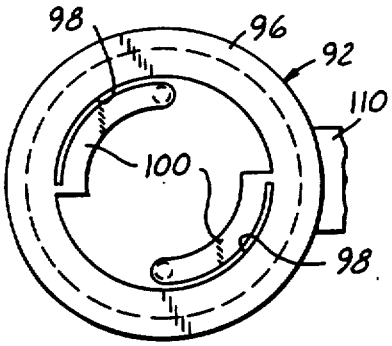
Figure 9:
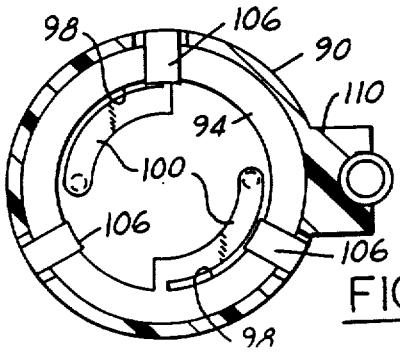

In FIGS. 10 to 12, a second modification is illustrated. As in FIG. 5, two housings 120, 122 are joined in a telescoping joint 124. Each housing has an inturned flange 126 at the open ends and three strike-in leaves 130 each with an inturned tab end 132. The tabs 132 on the resilient leaf springs 130 capture the pump housing 20, axially and radially to suspend it within the housings. Spaced side projections 140 are provided to mount the cage appropriately in a gas tank or canister.

In each of the embodiments, the cage or jacket units are preferably formed from a material which has sound deadening characteristics as well as inherent resilience so the supporting leafs with root ends integrally formed in the walls of the housings will support the pump housing axially and radially and absorb vibration and torsional motion without transmitting it to the supporting tank. In each embodiment the pump is spaced axially and radially from the interior walls of the enclosing cage.

What is claimed is:

1. In a vehicle having a fuel tank and an electrically driven pump in said tank for furnishing fuel under pressure to an engine, a pump mount for reducing the transmission of noise and vibration to the vehicle passenger compartment which comprises:

(a) a pump having generally cylindrical side walls with end walls lying in planes transverse to the pump axis, (b) a generally cylindrical outer container surrounding said pump having side walls spaced from said side walls of said pump and end walls formed by inturned flanges spaced from the end walls of said pump and having openings at each end within said flanges whereby liquid in a fuel tank may flow around said pump through said outer container, (c) means to support said pump radially and axially within said outer container comprising resilient strike-out portions from the walls of said outer container spaced circumferentially around said side walls having root portions integral with said container side walls and inwardly extending portions to contact the side walls of said pump to center the pump in said container spaced from the walls of said container.

2. A pump mount as defined in claim 1 in which at least one of said inturned flanges has arcuate strike-outs to provide resilient fingers with means to contact an end of said pump to support the pump resiliently and axially within said container.

* * * * *

UNITED STATES PATENT AND TRADEMARK OFFICE

CERTIFICATE OF CORRECTION

PATENT NO. : 4,964,787

DATED : October 23, 1990

INVENTOR(S) : Thomas M. Hoover

It is certified that error appears in the above—identified patent and that said Letters Patent is hereby corrected as shown below:

Delete Drawing Sheets 1 & 2. The Sheet of Drawing consisting of Figs. 3, 5, 6, and 8 should be added as shown on the attached sheet.

Signed and Sealed this

Twenty-eighth Day of April, 1992

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. :4,964,787

DATED :October 23, 1990

INVENTOR(S) :Thomas M. Hoover

It is certified that error appears in the above-identified patent and that said Letters Patent is hereby corrected as shown below:

Delete Drawing Sheets and replace with new attached Drawings.

Signed and Sealed this

Twenty-first Day of July, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,964,787

DATED : October 23, 1990

INVENTOR(S) : Thomas M. Hoover

It is certified that error appears in the above-identified patent and that said Letters Patent is hereby corrected as shown below:

Delete drawing sheets 1 and 2 and replace with new attached drawing sheets 1 and 2.

The certificate supersedes Certificate of Correction issued April 28, 1992 and July 21, 1992.

Signed and Sealed this

First Day of December, 1992

*Attest:*

*Attesting Officer*

DOUGLAS B. COMER

*Acting Commissioner of Patents and Trademarks*